US006592116B2

(12) United States Patent
Focke et al.

(10) Patent No.: US 6,592,116 B2
(45) Date of Patent: Jul. 15, 2003

(54) APPARATUS FOR HANDLING BLANKS, IN PARTICULAR REVENUE STAMPS FOR CIGARETTE PACKS

(75) Inventors: Heinz Focke, Verden (DE); Jürgen Röse, Kirchlinteln (DE)

(73) Assignee: Focke & Co. (GmbH), Verden (DE)

( * ) Notice: Subject to any disclaimer, the term of this patent is extended or adjusted under 35 U.S.C. 154(b) by 135 days.

(21) Appl. No.: 09/779,958

(22) Filed: Feb. 9, 2001

(65) Prior Publication Data

US 2002/0158400 A1 Oct. 31, 2002

(30) Foreign Application Priority Data

Feb. 16, 2000 (DE) ..... 100 07 089

(51) Int. Cl.[7] ..... B65C 9/10

(52) U.S. Cl. ..... 271/9.08; 156/568; 156/570; 221/105; 221/113; 221/133

(58) Field of Search ..... 271/9.08; 156/568, 156/570–572; 221/11, 105, 113, 133

(56) References Cited

U.S. PATENT DOCUMENTS

| | | | | |
|---|---|---|---|---|
| 3,929,326 A | | 12/1975 | Seragnoli | |
| 4,240,868 A | * | 12/1980 | Nagano | 156/572 |
| 4,319,948 A | | 3/1982 | Volkert | |
| 4,907,941 A | | 3/1990 | Focke | |
| 5,472,114 A | * | 12/1995 | Cragun | 221/105 |
| 5,545,286 A | * | 8/1996 | Schaupp | 156/568 |
| 5,569,353 A | * | 10/1996 | Zodrow | 156/564 |
| 6,244,017 B1 | * | 6/2001 | Focke et al. | 53/147 |

FOREIGN PATENT DOCUMENTS

| | | |
|---|---|---|
| DE | ZPS 12 38 384 | 10/1967 |
| DE | 29 48 606 C2 | 5/1986 |
| DE | 44 17 497 A1 | 11/1995 |
| DE | 197 30 307 A1 | 1/1999 |
| DE | 197 43 120 A1 | 4/1999 |
| DE | 198 08 791 | 9/1999 |
| DE | 199 26 713 | 12/2000 |
| EP | 1 060 993 A2 | 2/2000 |

* cited by examiner

*Primary Examiner*—Christopher P. Ellis
*Assistant Examiner*—Mark A. Deuble
(74) *Attorney, Agent, or Firm*—Thomas, Kayden Horstemeyer & Risley LLP; Todd Deveau

(57) ABSTRACT

Apparatus for supplying and transferring blanks, in particular revenue stamps, to (cigarette) packs a supply of blanks being stored in at least one upright magazine shaft from which the blanks are removed individually on the underside. In order to increase the capacity, a loading station with a supply unit for blanks is arranged at a distance from a transfer station assigned to the packs, to be precise in a disruption-free, easily reachable region of the packaging machine.

19 Claims, 10 Drawing Sheets

21
37
42
41
40
47
23
VI
VI
18
44
77
53/54
50
52
10
10
10
10
10
51
43
49
45
38
39

38
41
42
44
41
42
47
49
10
46
43
45
48
46
10
42
45

27
54
54
50
10
67
60
68
56
63
57
65
55
72
74
61
73
60
19
64
62
10
58
10
15
59
11
16

APPARATUS FOR HANDLING BLANKS, IN PARTICULAR REVENUE STAMPS FOR CIGARETTE PACKS

This is a priority application based upon German patent application 100 07 089.2 filed Feb. 16, 2000.

FIELD OF THE INVENTION

The invention relates to an apparatus for handling blanks, in particular revenue stamps for cigarette packs, namely for supplying and for feeding the same to a processing subassembly or to a cigarette pack, having an essentially upright shaft or magazine in which the blanks are stacked one above the other and on the underside of which the blanks can be removed individually by a removal element and conveyed away.

BACKGROUND OF THE INVENTION

The handling of, in particular, small, thin-walled blanks, such as revenue stamps, coupons, etc. for (cigarette) packs, poses problems in packaging technology on account of the high operating speed of the packaging machines. Such blanks, in particular revenue stamps, in practice are prepared, namely cut to size and introduced into an upright, shaft-like magazine as a stack, predominantly outside the packaging machine. The blanks are removed from said magazine one after the other on the underside and fed to the packs.

SUMMARY OF THE INVENTION

The object of the invention is to increase the capacity of an apparatus for supplying and handling such blanks and also to improve the reliability during handling.

In order to achieve this object, the apparatus according to the invention is characterized in that the shaft or the magazine (for the blanks) comprises at least two sub-shafts arranged one above the other, namely a bottom (smaller) base shaft and a top supply shaft, which can be removed from the base shaft once it has been emptied and can be positioned on the base shaft (again) once it has been filled with blanks. Once the supply shaft has been emptied, there is still a sufficient stock of blanks remaining in the preferably fixed base shaft. The supply shaft that has been removed is replaced by a filled, new supply shaft, with the result that the entire contents of the magazine are available again within a short period of time.

A further special feature relates to the increase in the capacity of the blank magazine by arranging a plurality of sub-shafts, namely supply shafts, on an endless conveyor, in particular on the outer circumference of a rotatable carousel. Shafts or supply shafts filled with blanks are moved one after the other to a transfer station and into a position above a base shaft. The relevant supply shaft is connected to the base shaft. Following emptying, the carousel is rotated one step further. The supply shafts can easily be removed from the carousel and attached to the same.

The spatial positioning of the large-volume blank magazine, formed by the supply shafts, at a distance from a processing station for the blanks is also of particular importance. The blank magazine, in particular the carousel fitted with supply shafts, is accommodated at a freely accessible position of the packaging machine which is favourable for charging purposes, in particular laterally alongside the machine. The blanks are transported from this loading station via a relatively long conveying path, namely via a blank conveyor, into the processing region, in particular into the region of a drying turret for providing the blanks or revenue stamps on the packs.

Finally, a removal element, namely a pusher, by means of which the individual blanks are removed from a transfer shaft in the region of the processing station is important.

BRIEF DESCRIPTION OF THE DRAWINGS

Further (special) features of the invention are explained specifically hereinbelow with reference to exemplary embodiments and details of the apparatus. In the figures.

DETAILED DESCRIPTION OF PREFERRED EMBODIMENT

Figure 1:
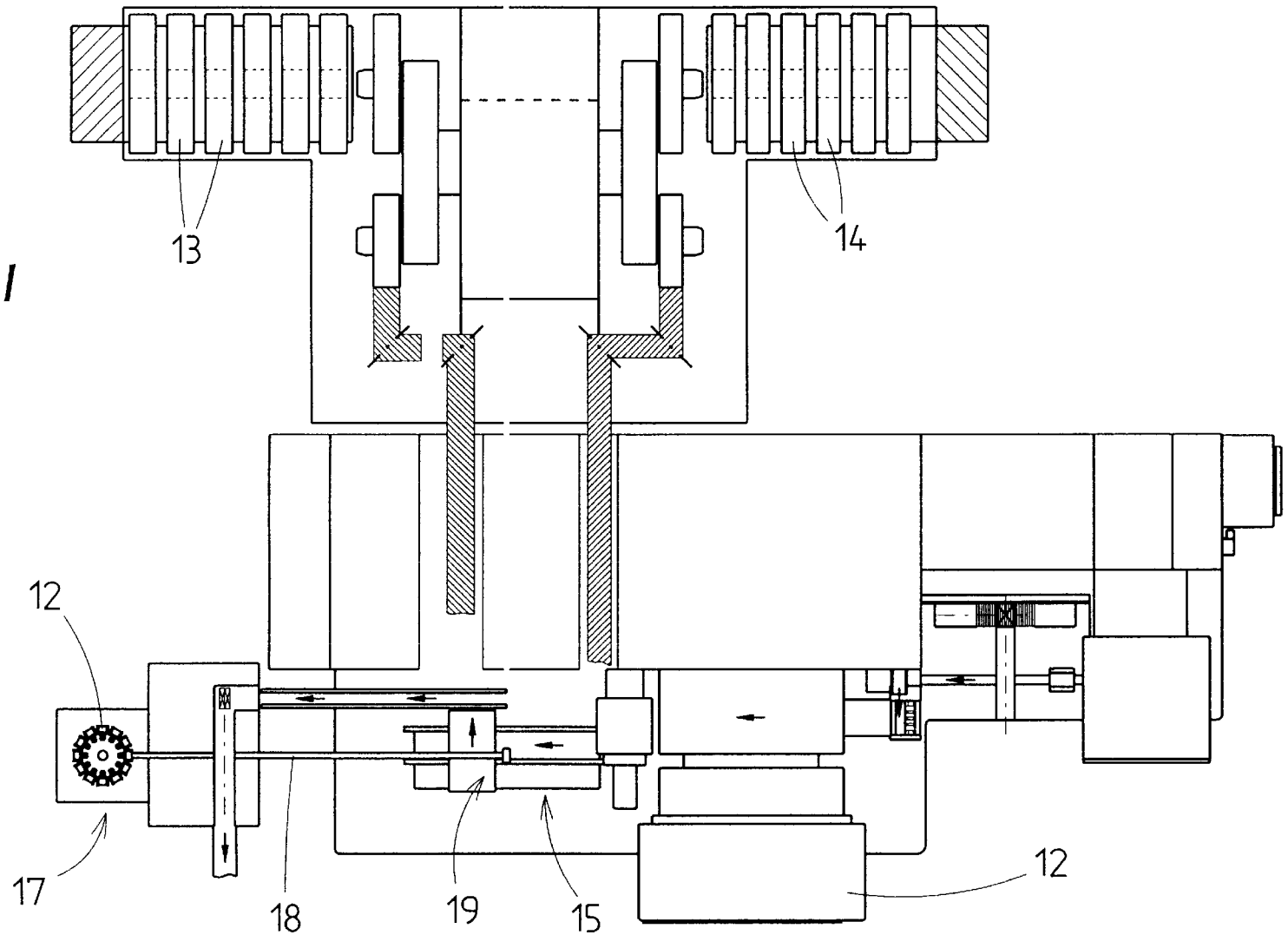
FIG. 1 shows a vastly simplified plan view of a packaging machine.
Figure 2:
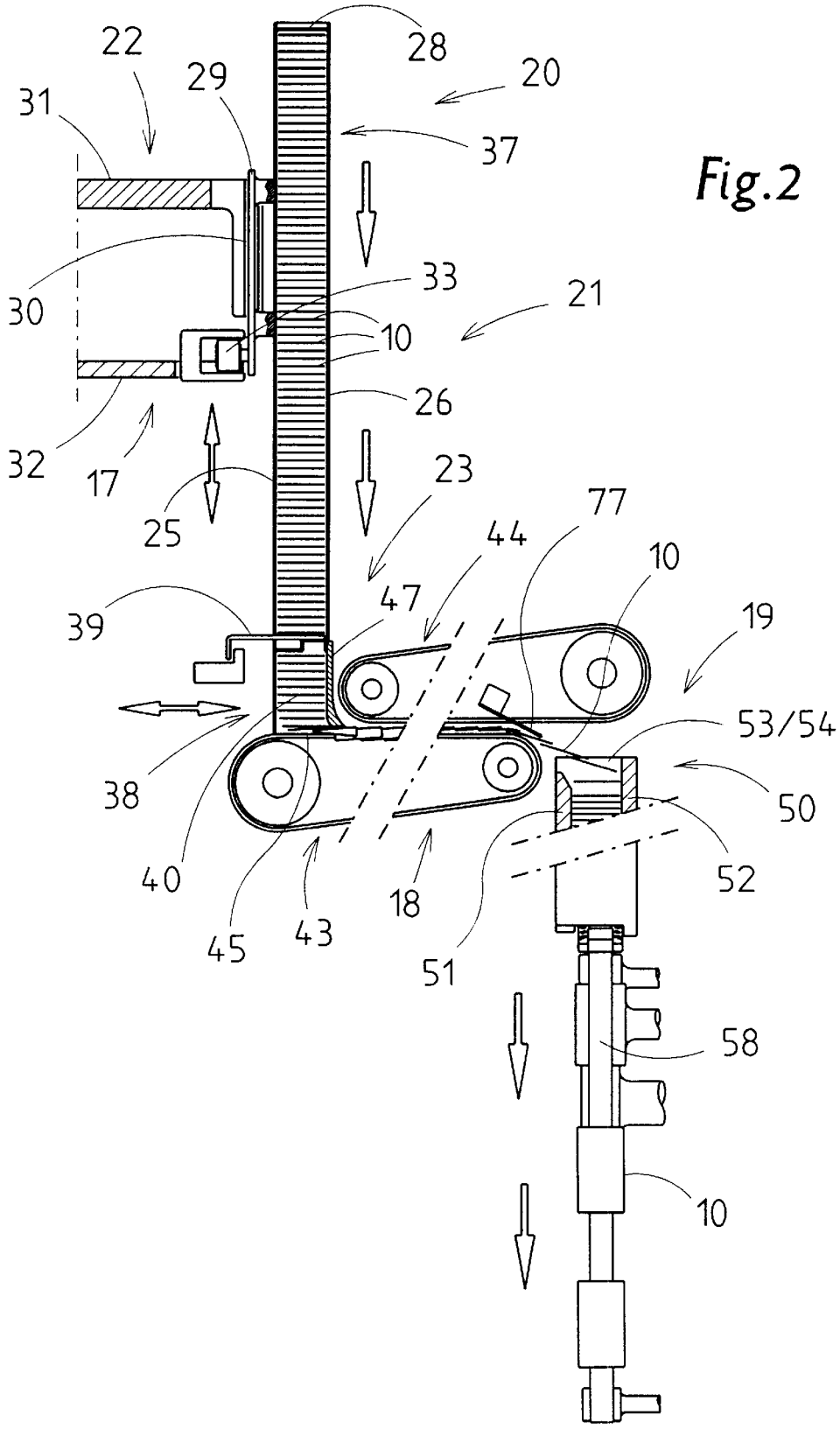
FIG. 2 shows a side view, partially in section, of the apparatus for handling blanks.
Figure 3:
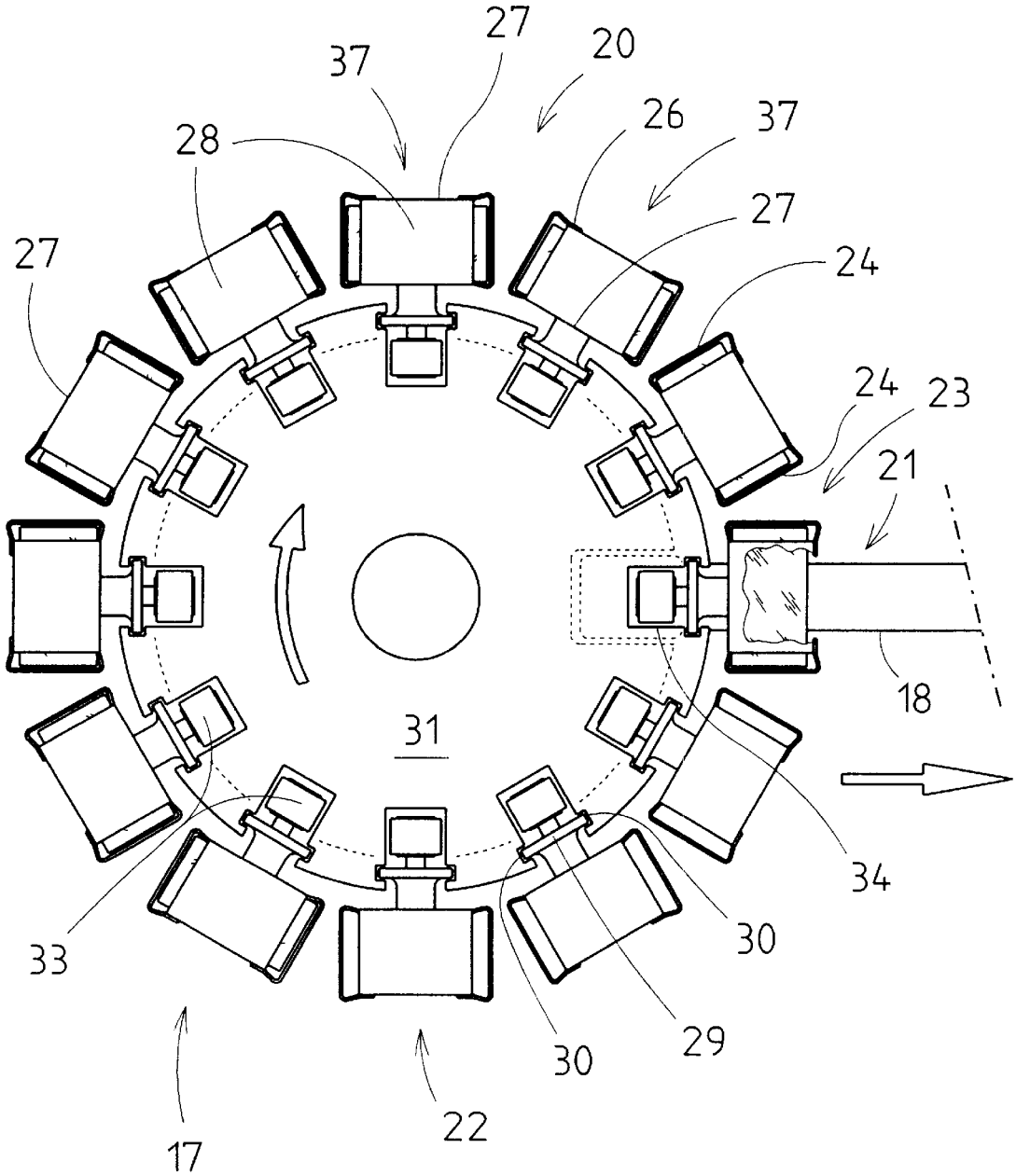
FIG. 3 shows a plan view of a detail of the apparatus according to FIG. 2, namely a (magazine) carousel.
Figure 4:
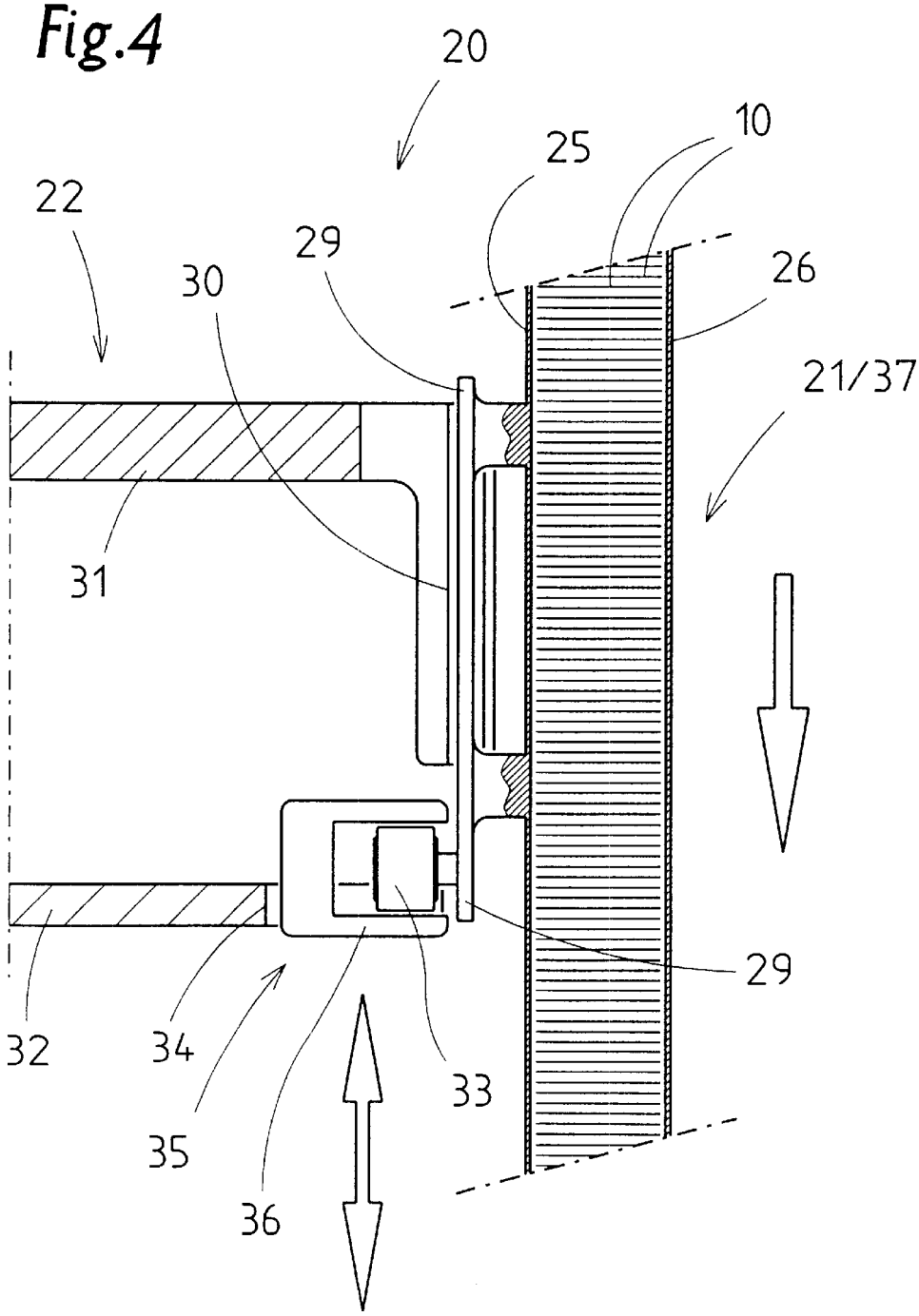
FIG. 4 shows, on an enlarged scale, a vertical section of a detail of the apparatus according to FIG. 3.

The apparatus as illustrated in the drawings concern the handling of small blanks 10, namely in particular paper revenue stamps for cigarette packs 11.

FIG. 1 shows, as a use example, a packaging machine for producing cigarette packs 11 of the soft-carton type. The central element in the packaging machine shown in plan view is a folding turret 12 on the front side of the packaging machine. Illustrated opposite, namely on the rear side, is a material-supply arrangement. Reels 13, 14 for inner blanks (tin foil) and outer blanks (paper) are arranged in magazines. A material web of the appropriate packaging material is drawn off in each case from one of the reels 13, 14 and fed to blank elements which sever blanks from the material webs and feed them to the folding turret 12.

Figure 8:
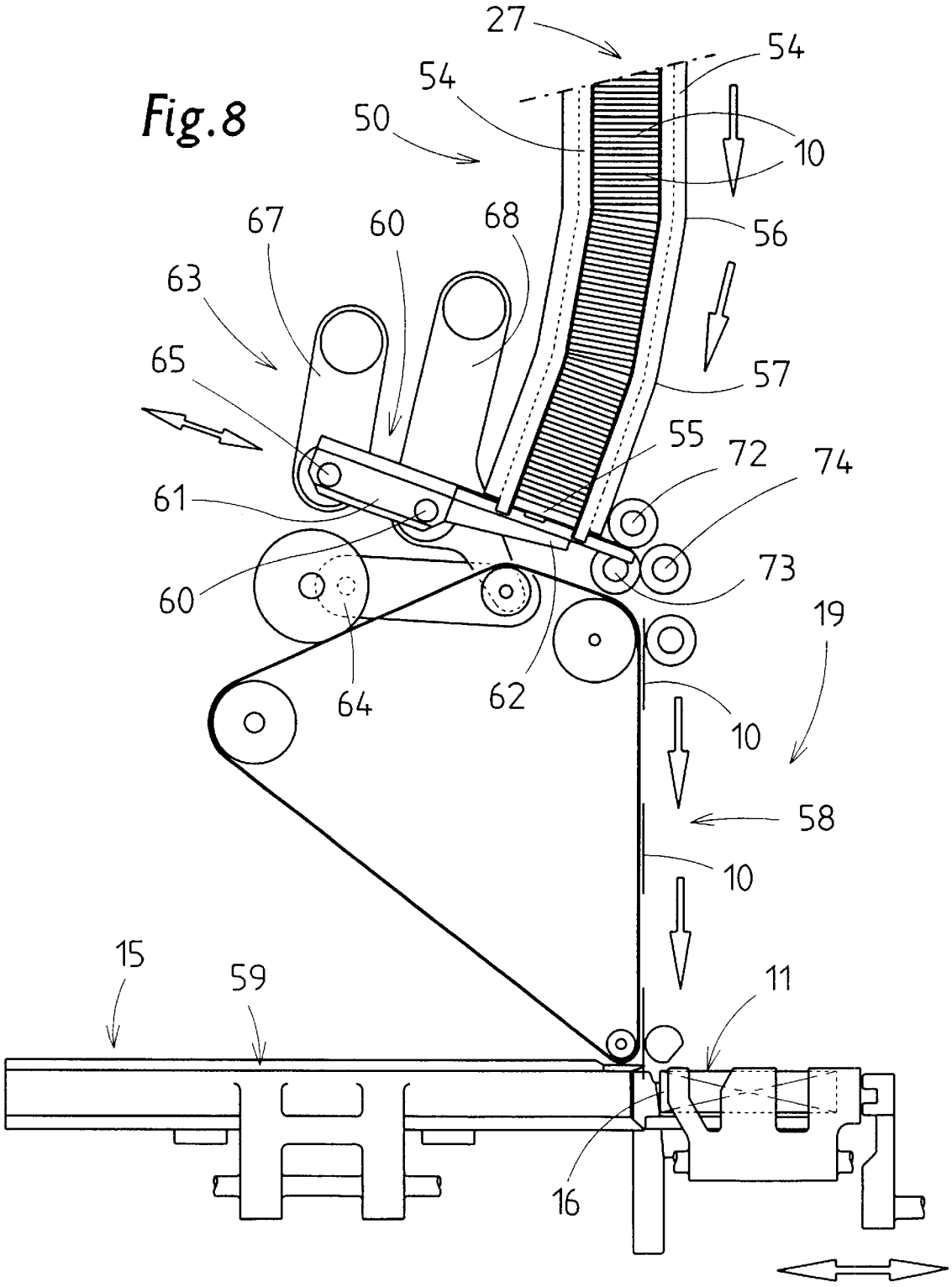
FIG. 8 shows a station for transferring blanks to a processing apparatus or to packs.

Following the folding turret 12, the largely completed cigarette packs 11 are fed to a drying turret 15. In the region of the latter, the revenue stamp or the blank 10 is positioned on the (cigarette) pack 11, to be precise usually in the region of an end surface 16 (FIG. 8).

The packaging machine is supplied with the blanks 10 or revenue stamps in a particular manner. A loading station 17 with a high-capacity blank supply is formed at a position remote from the processing station—drying turret 15. The loading station 17 is positioned such that easy access is possible, to be precise without disrupting the machine operation. In the present case, the loading station 17 is thus arranged laterally alongside the packaging machine. The blanks 10 are transported from the loading station 17 via a relatively long path, to be precise by a blank conveyor 18, as far as a transfer station 19 arranged above the drying turret 15.

The blanks 10 or revenue stamps are handled using essentially upright shafts as a magazine for accommodating the blanks 10 on a temporary basis. Said blanks are positioned one above the other in the shafts and are moved downwards under their own weight. On the bottom, partially open side, the blanks 10 are removed and conveyed away.

A supply unit 20 for blanks 10 is formed in the loading station 17, to be precise with a plurality of supply shafts 21. These each contain a multiplicity of blanks 10 arranged one above the other. The supply shafts 21 are arranged on an endless conveyor, to be precise on a carousel 22. The latter conveys the supply shafts 21 one after the other into the region of a removal station 23. In the region of the latter, the blanks 10 are removed from the supply shafts 21 at the bottom and transported away by the blank conveyor 18.

Figure 6:
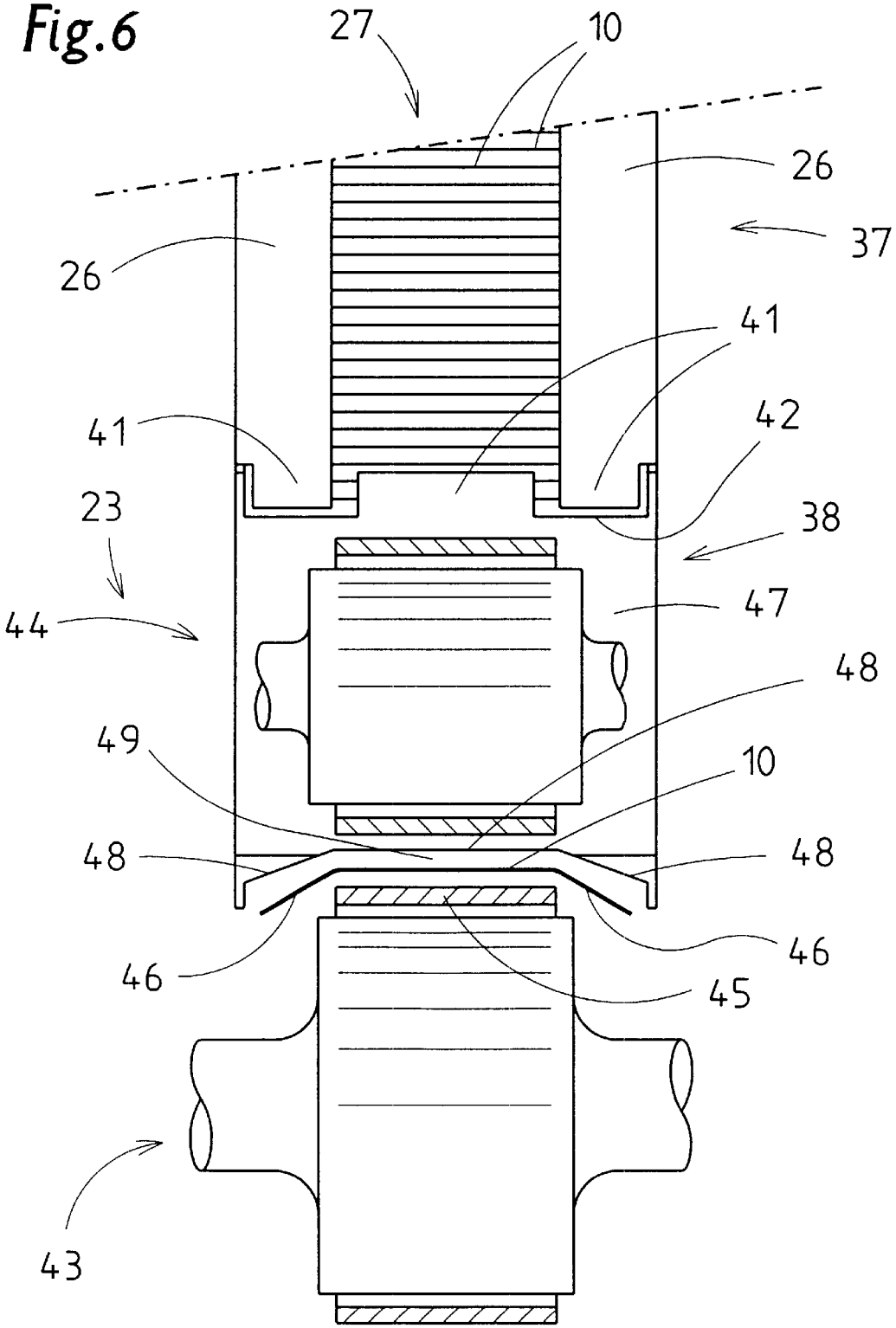
FIG. 6 shows the apparatus according to FIG. 5 in a cross-sectional illustration along section plane VI—VI from FIG. 5.

The carousel 22 as a retaining means for the supply shafts 21 is of particular design. Each supply shaft 21 comprises (relatively narrow) side walls 24, an inner wall 25, which is directed towards the carousel 22, and an outer wall 26 located opposite. The latter comprises two border-side legs, between which a free strip-like opening 27 is defined (FIG. 6). The top side of the supply shafts 21 is closed by a top wall 28.

The supply shafts 21 are retained on the carousel 22 in a removable manner by way of the (relatively wide) inner wall 25. For this purpose, an upright retaining web 29 is fastened on the supply shaft 21, at a distance from the inner wall 25, via two connections. The retaining web 29 is inserted into a guide 30 which is provided on the outer border of the carousel 22 and has an upright slot.

The carousel 22 essentially comprises two axially spaced-apart panels, namely a (top) retaining panel 31 and a supporting panel 32. The securing means or guides 30 are arranged on the retaining panel 31. The supply shaft 21 or the retaining web 29 thereof is supported on the supporting panel 32 by way of a bottom supporting element. The latter is a supporting roller 33 with a horizontal axis of rotation. The supporting panel 32 of the carousel 22 is arranged in a fixed manner, while the retaining panel 31 rotates in a stepped manner. During the rotation, the supporting roller 33 runs on the border of the supporting panel 32.

In the region of the removal station 23, the supporting panel 32 is provided with a recess 34. In this region, the supporting roller 33 is retained by another supporting element with a lower-level supporting plane. This other supporting element is a U-shaped retaining means 35 which is fixed in position and has a bottom carrying leg 36. The supporting surface of the latter for the supporting roller 33 is located at a lower level than the plane of the supporting panel 32, with the result that the supply shafts 21 execute a corresponding downward movement in the removal station 23.

Figure 5:
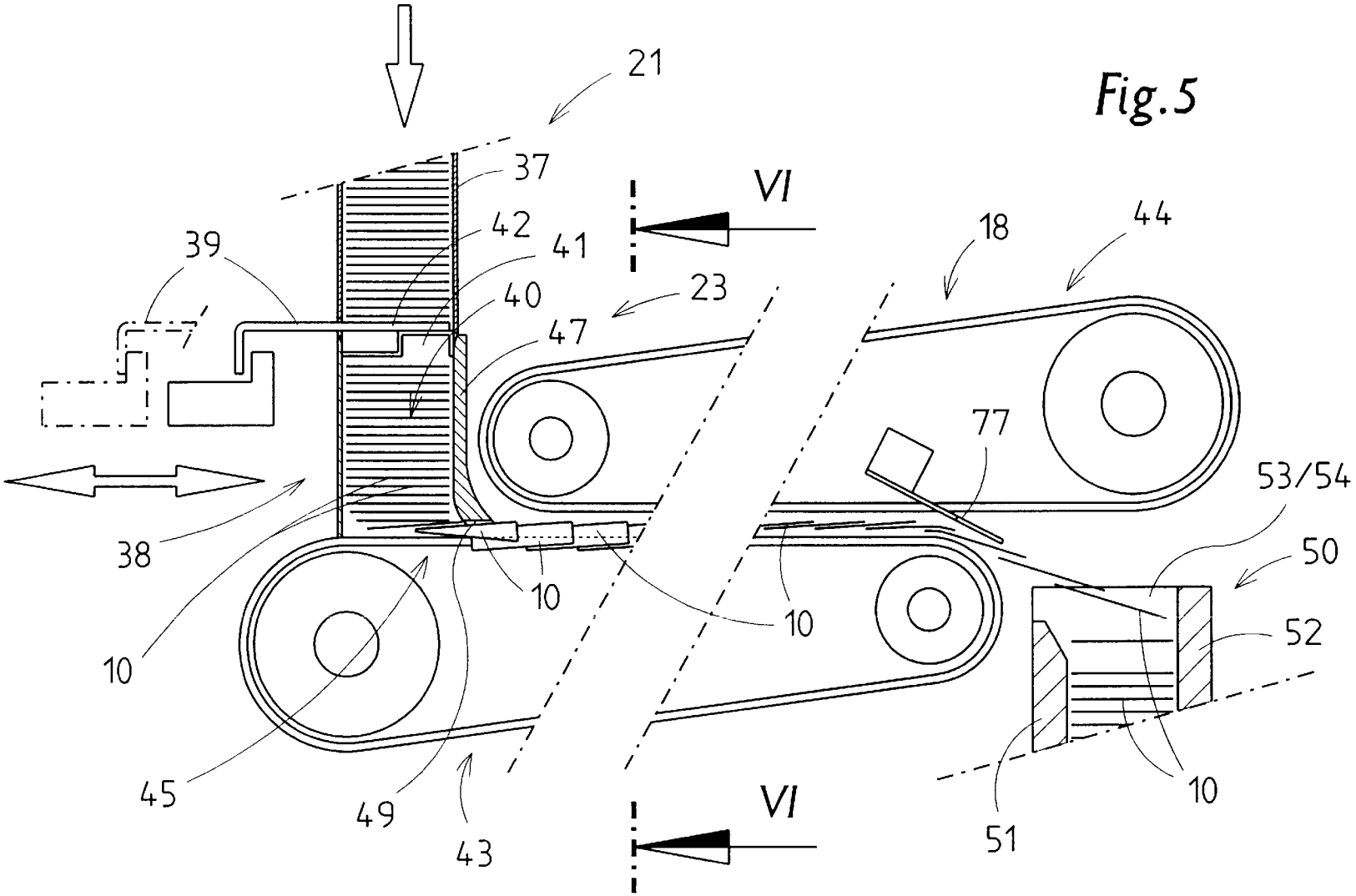
FIG. 5 shows a side view, partially in vertical section and on an enlarged scale, of a further detail of the apparatus according to FIG. 2, namely an apparatus for removing blanks from a shaft.

The supply shafts 21 are of particular, namely two-part design in order to ensure rational loading and removal of the blanks 10. The supply shaft 21 comprises a top movable shaft part, namely a collecting shaft 37, and a (considerably smaller) bottom base shaft 38. The latter is fixed in position in the region of the removal station 23. The collecting shaft 37 filled with blanks 10 is fed to the removal station 23 and, in the region of the latter, positioned on the base shaft 38 by virtue of a downward movement of the collecting shaft 37. The collecting shaft 37 is open at the bottom. The blanks 10 are supported—temporarily—on a closure element, namely on a slide plate 39. In the region of the removal station 23, said slide plate is drawn out of the closed position into an open position (chain-dotted lines in FIG. 5) by an actuating element. This renders the collecting shaft 37 open at the bottom. The stack of blanks 10 drops downwards as a result of its own weight and combines with a residual stock 40 of blanks 10 in the base shaft 38.

The underside of the collecting shaft 37 and top side of the base shaft 38 are of particular design in order to ensure form-fitting connection of these two sub-shafts. The bottom border and top border, respectively, of the shaft walls are provided with protrusions 41 and corresponding depressions 42. The top and bottom protrusions 41 and depressions 42 correspond with one another in terms of size, shape and positioning, with the result that the top collecting shaft 37 is positioned in a form-fitting and centring manner on the base shaft 38. The protrusions and hollows ensure that there is no continuous, rectilinear and/or horizontal connecting edge between the shaft parts which could result in the progressively downwardly moving blanks 10 catching.

The supply shafts 21 or the top parts of the same (collecting shaft 37) are filled such that, with reversed positioning, the blanks 10 are introduced in stacks into the upwardly directed (bottom) open side. The top wall 28 here serves as a base. Once the collecting shaft 37 has been filled, the slide plate 39 is moved into the closed position and the collecting shaft 37 is attached to the carousel 22 the other way round.

Removing the blanks 10 from the supply shaft 21 in the region of the removal station 23, and transporting them away, is a special operation. The blank conveyor 18 comprises two endless conveyors, namely a bottom belt conveyor 43 and a top belt conveyor 44. The bottom belt conveyor 43 has a top conveying strand 45 extending into the region beneath the base shaft 38, which is open at the bottom. The top belt conveyor 44 serves, over the conveying path, as the top abutment for fixing the blanks 10 on the belt conveyor 43. At the least the bottom belt conveyor 43 comprises a material or a surface with a high coefficient of friction, for example silicone, in order to ensure that the blanks 10 are reliably carried along and guided.

Figure 7:
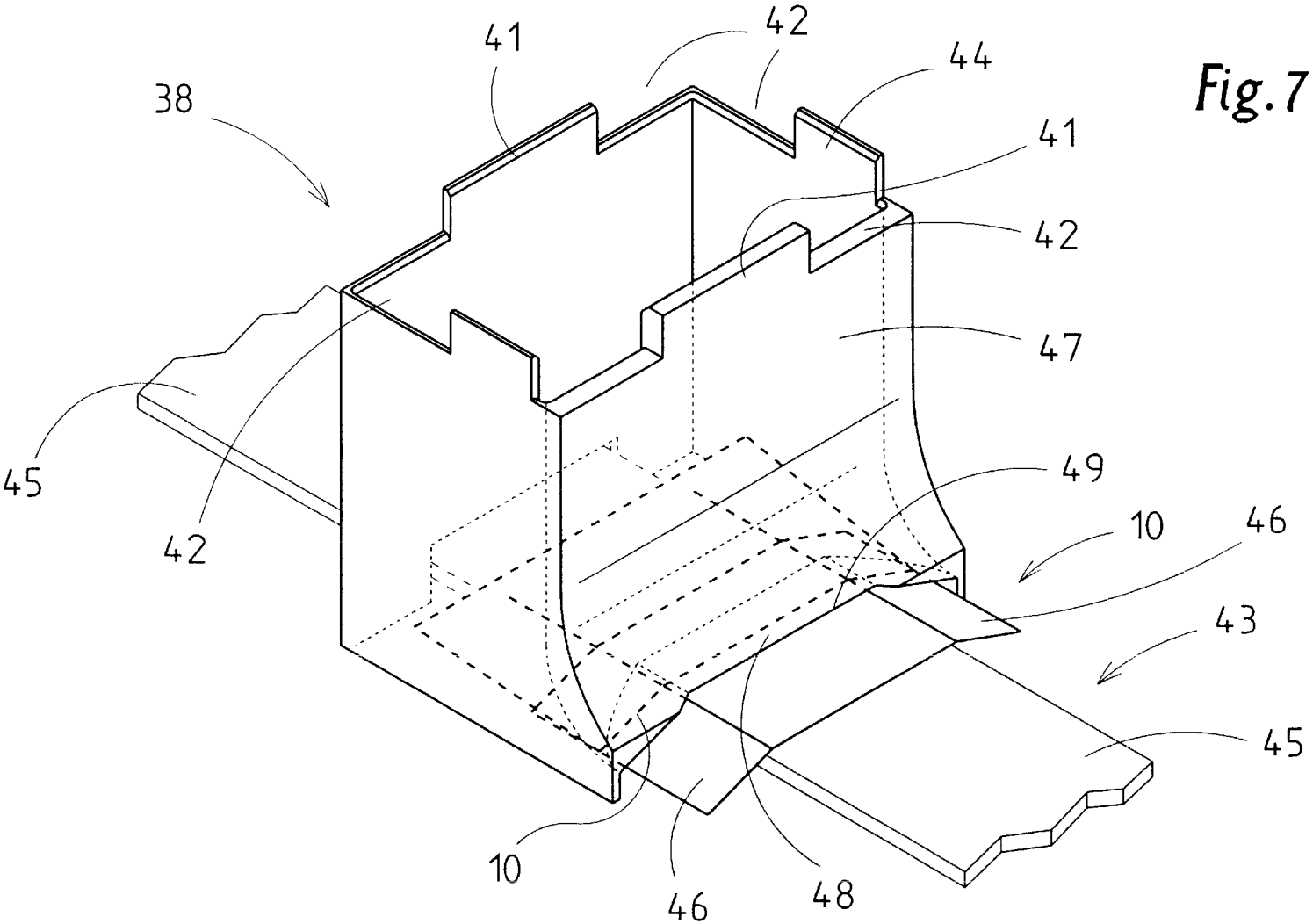
FIG. 7 shows, on an enlarged scale, a perspective illustration of a bottom part of a blank shaft, namely a base shaft.

The width of the belts of the belt conveyors 43, 44 is considerably smaller than the dimensions or length of the (rectangular) blanks 10. The latter have their longitudinal extent located transversely on the belt conveyor 43. Lateral blank legs 46 project beyond the belt conveyor 43 or the conveying strand 45 thereof and are angled downwards slightly during the removal phase from the base shaft 38 (FIGS. 6 and 7). As the transporting phase continues in the region of the blank conveyor 18, the blanks 10 automatically return into a straightened-out position.

A particular configuration of the base shaft 38 ensures that the blanks 10 are carried along by the bottom belt conveyor 43. The front wall 47 of said base shaft is shaped. The comparatively thick front wall 47 forms, at the bottom, an arcuate or laterally downwardly angled run-out end, which terminates directly above the conveying strand 45. Guide surfaces 48, which form two downwardly directed sub-surfaces laterally, are defined in this region. During passage through a slot 49, formed by the front wall 47, above the conveying strand 45, the blanks 10 gripped by the conveying strand 45 are brought into the shape according to FIGS. 6 and 7, with downwardly angled blank legs 46. This results in a stable form of the blanks 10, which ensures that the latter are carried along. Following blanks 10 are held back by the shape of the slot 49 before they pass into the region of the same. By virtue of the belt 43 being designed as a friction belt, in each case only the bottom blank 10 is carried along and, being deformed in the process, transported away. The next, following blank 10 is gripped by the belt conveyor 43 and likewise carried along as soon as a sufficient surface area rests on the conveying strand 45. This results in imbricated positioning of the blanks 10 with the latter partially overlapping one another.

The conveying strands of the belt conveyors 43, 44 may butt elastically against one another in the region of the conveying path by virtue of corresponding pressure-exerting elements.

The transfer station 19, in the region of which the blanks 10 are transferred to the packs 11, is likewise equipped with a shaft-like magazine for the blanks, namely with a transfer shaft 50. The latter is designed analogously to the supply shaft 21, that is to say it is bounded by a front wall 51, by a rear wall 52 and by side walls 53, 54. One side wall 54 comprises two wall legs which bound a central, strip-like opening.

The transfer shaft 50 is positioned in a stationary manner and is open on the top side, where the blanks 10 are introduced from the blank conveyor 18. In this case, the blanks 10 are moved freely over a short path until they butt against the rear wall 52. The front wall 51 is set back some way in the downward direction in relation to the top border of the transfer shaft 50.

The transfer of the blanks 10 from the blank conveyor 18 to the transfer shaft 50 is assisted by a directing element 77, namely a downwardly inclined guide plate which is positioned above the belt conveyor 43, in the region of a deflection of the same.

The transfer shaft 50 is shaped so as to form a top, vertical section, while a bottom removal opening 55 is located in an obliquely directed plane, corresponding to a removal plane for the blanks 10. For this purpose, the transfer shaft 50 has a number of inflections, in the present exemplary embodiment it is provided with two points of inflection 56, 57.

The blanks 10 removed individually, at a distance apart from one another, from the transfer shaft 50 are fed to a transfer conveyor 58. The latter is designed as a suction belt and it transports the blanks 10 until they are transferred to the cigarette packs 11, to be precise in the downward direction. The transfer of the blanks to the cigarette pack 11, namely to the end surface 16, takes place by the cigarette pack 11 being pushed into a securing means, namely into an elongate pocket 59 of the drying turret 15.

The blanks 10 are removed from the transfer shaft 50 by a pusher 60 which can be moved back and forth in the oblique removal plane. The pusher 60 comprises a rear retaining member 61—as seen in the direction in which the blanks 10 are conveyed away—and a carrying member 62 which is located in the region of the transfer shaft 50 and is intended for gripping and carrying along the blank 10. The retaining member 61 is connected to a mechanism, namely to a parallelogram mechanism 63. The latter is driven back and forth by a crank 64. The retaining member 61 is connected to free ends of pivotably mounted parallel levers 67, 68 by two bearings 65, 66. The crank 64 causes the pusher 60 to move back and forth in the oblique plane.

The carrying member 62 has a front abutment region for the blank 10. Said abutment region is of cross-sectionally trapezoidal design with downwardly inclined lateral, strip-like retaining surfaces 69, 70. Arranged in this region are suction bores 71, which are connected to a negative-pressure source in order to grip the blanks 10 at lateral borders. A special feature of the present example is that in each case two (additional) suction bores 78 are arranged in the rear region of the pusher 60, with the result that the blank 10 is gripped virtually over the entire length on both sides by suction bores 71, 78.

Figure 9:
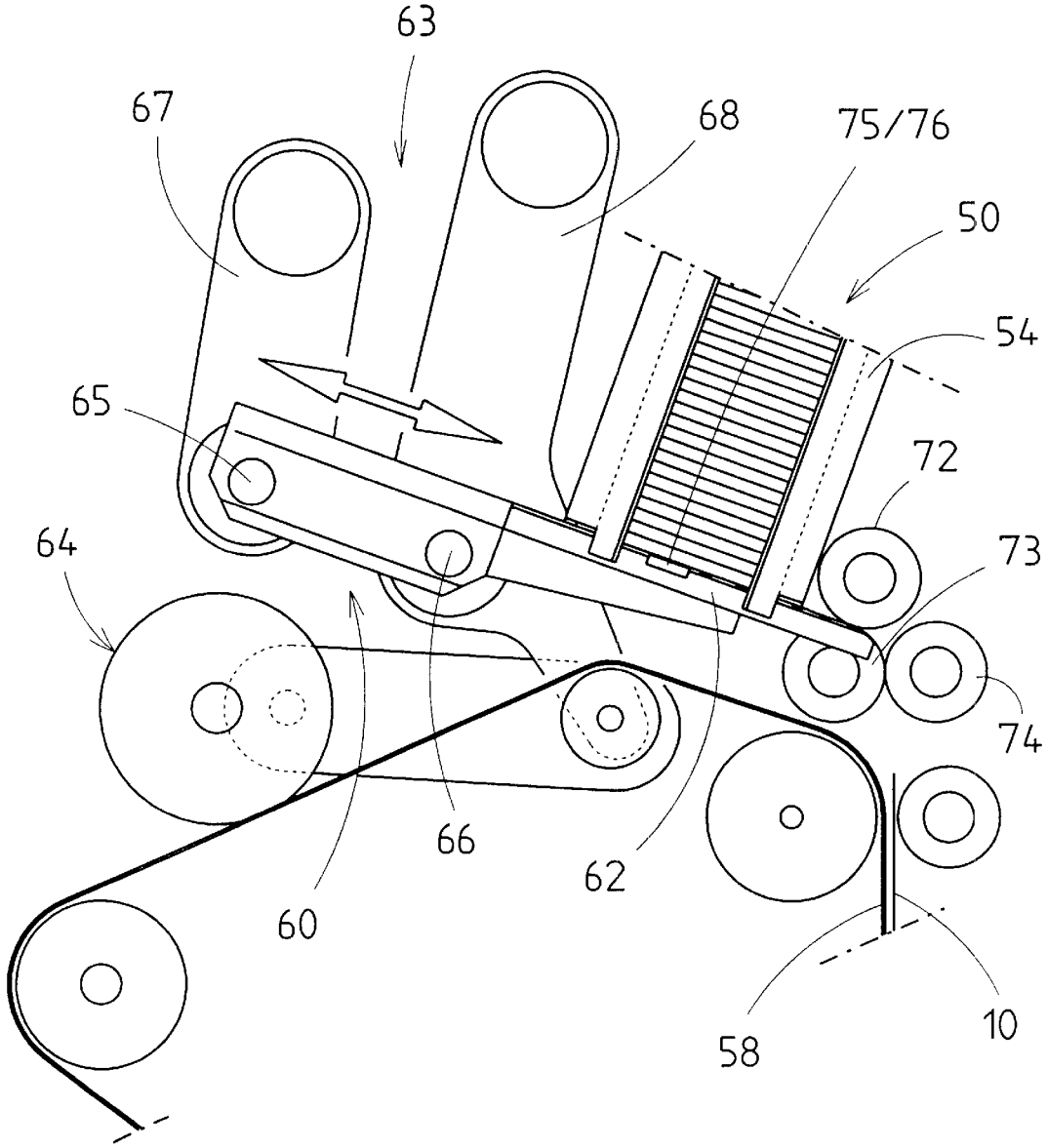
FIG. 9 shows, on an enlarged scale, a detail of the apparatus according to FIG. 8, namely a removal element for blanks.
Figure 10:
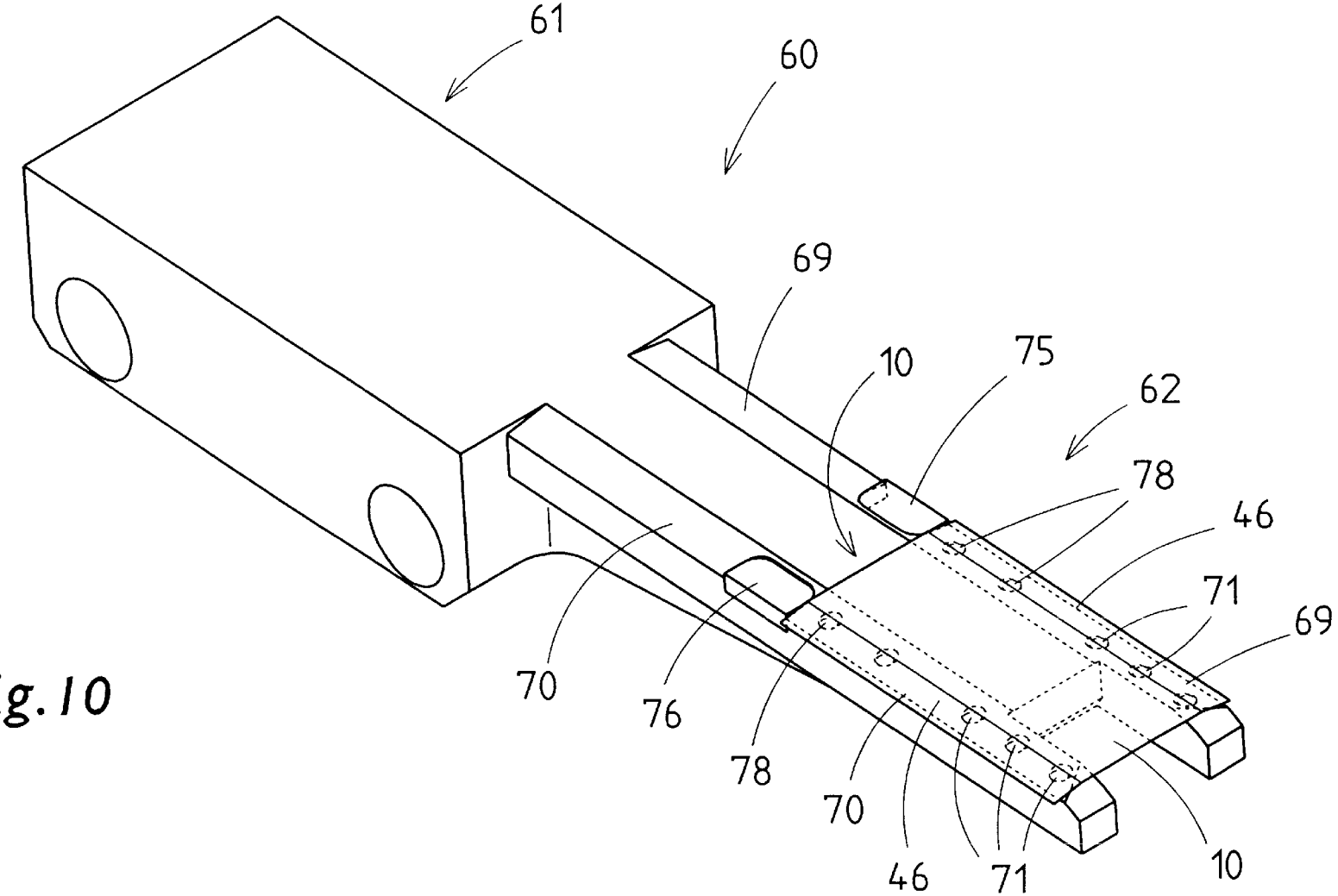
FIG. 10 shows a perspective illustration, once again on an enlarged scale, of the removal element in detail form.

In the drawn-back position of the pusher 60, the region with the retaining surfaces 69, 70 is located beneath the transfer shaft 50. A bottom blank 10 is gripped and fixed by the suction bores 71 on the obliquely downwardly sloping retaining surfaces 69, 70. Lateral regions of the blank 10 are thus angled correspondingly downwards. In this arrangement, corresponding movement of the pusher 60 carries along the blank 10 and transfers it to first drawing-off rollers 72, 73. The latter grip the blank 10 in a leading region. The pusher 60 is of fork-like design in this region (FIG. 9), with the result that the drawing-off rollers 72, 73 can grip the free region of the blank 10.

The blank 10 received from the pusher 60 is then deflected into a downwardly directed conveying plane by interaction with a further drawing-off roller 74. The drawing-off roller 73, which is positioned beneath the movement plane of the blank 10, thus interacts both with the first drawing-off roller 72 and with the second, offset drawing-off roller 74 in order to bring about the conveying-away and deflecting operations.

A special feature of the pusher 60 is that, in the region of the carrying member 62, additional, mechanical auxiliary elements ensure that the blank 10 is carried along reliably even at high conveying speeds. Carry-along elements 75, 76 are provided in the region of the obliquely downwardly inclined retaining surfaces 69, 70. Said carry-along elements grip a trailing transverse edge of the blank 10 in the region of the retaining surfaces 69, 70 and ensure that the blank 10 is reliably carried along and aligned without acting on the next-following blank 10 in the transfer shaft 50. For this purpose, the carry-along elements 75, 76 are positioned such that they are located entirely beneath the plane of the straightened-out blank 10 and/or beneath the next-following blank 10, that is to say they grip the blank 10 only in the region of the downwardly deformed lateral legs 46.

The apparatus may also be designed such that the loading station 17 and removal station 23 are combined. In this case, the transfer shaft 50 may be integrated in the supply system with carousel 22 or the like. In this case, the transfer shaft 50 is expediently of two-part design, as described in conjunction with the supply shaft 21.

List of designations

| | |
|---|---|
| 10 | Blank |
| 11 | Cigarette pack |
| 12 | Folding turret |
| 13 | Reel |
| 14 | Reel |
| 15 | Drying turret |
| 16 | End surface |
| 17 | Loading station |
| 18 | Blank conveyor |
| 19 | Transfer station |
| 20 | Supply unit |
| 21 | Supply shaft |
| 22 | Carousel |
| 23 | Removal station |
| 24 | Side wall |
| 25 | Inner wall |

-continued

| List of designations | |
|---|---|
| 26 | Outer wall |
| 27 | Opening |
| 28 | Top wall |
| 29 | Retaining web |
| 30 | Guide |
| 31 | Retaining panel |
| 32 | Supporting panel |
| 33 | Supporting roller |
| 34 | Recess |
| 35 | Retaining means |
| 36 | Carrying leg |
| 37 | Collecting shaft |
| 38 | Base shaft |
| 39 | Slide plate |
| 40 | Residual stock |
| 41 | Protrusion |
| 42 | Depression |
| 43 | Belt conveyor |
| 44 | Belt conveyor |
| 45 | Conveying strand |
| 46 | Blank leg |
| 47 | Front wall |
| 48 | Guide surface |
| 49 | Slot |
| 50 | Transfer shaft |
| 51 | Front wall |
| 52 | Rear wall |
| 53 | Side wall |
| 54 | Side wall |
| 55 | Removal opening |
| 56 | Point of inflection |
| 57 | Point of inflection |
| 58 | Transfer conveyor |
| 59 | Pocket |
| 60 | Pusher |
| 61 | Retaining member |
| 62 | Carrying member |
| 63 | Parallelogram mechanism |
| 64 | Crank |
| 65 | Bearing |
| 66 | Bearing |
| 67 | Lever |
| 68 | Lever |
| 69 | Retaining surface |
| 70 | Retaining surface |
| 71 | Suction bore |
| 72 | Drawing-off roller |
| 73 | Drawing-off roller |
| 74 | Drawing-off roller |
| 75 | Carry-along element |
| 76 | Carry-along element |
| 77 | Directing element |
| 78 | Suction bore |

We claim:

1. Apparatus for handling blanks, in particular revenue stamps for cigarette packs, namely for supplying and for feeding the same to a processing subassembly or to a cigarette pack, the apparatus comprising:

a rotatable carousel;

a plurality of collecting shafts provided on the rotatable carousel, the collecting shafts having blanks therein stacked one above the other, the collecting shafts being vertically displaceable, each collecting shaft having an upper initial position on the rotatable carousel;

a fixed base shaft over which the collecting shafts can be positioned, one at a time, by virtue of the rotatable carousel; and a blank conveyor for removing the blanks individually in succession from a lower end of the fixed base shaft;

wherein the blank conveyor removes the blanks from the fixed base shaft when a respective collecting shaft is positioned over the fixed base shaft, and when the respective collecting shaft is vertically displaced from the upper initial position to a lower position, at which lower position the respective collection shaft physically communicates with the fixed base shaft.

2. Apparatus according to claim 1, further comprising:

lateral vertical guides to mount each collecting shaft to the rotatable carousel;

supporting rollers to retain each collecting shaft to the rotatable carousel; and retaining means retaining the supporting rollers.

3. Apparatus according to claim 1, wherein the collecting shafts are arranged on the rotatable carousel in a removable manner by a lateral securing assembly, each collecting shaft being retained by a vertical guide with a bottom, movable support.

4. Apparatus according to claim 1, wherein each collecting shaft has a bottom closure element which, once the collecting shaft has been set down on the fixed base shaft, can be drawn back such that the collecting shaft is free in the downward direction towards the fixed base shaft.

5. Apparatus according to claim 4, wherein the bottom closure element is a movable slide plate.

6. Apparatus according to claim 1, wherein supply shafts form a supply unit which is positioned in the region of a packaging machine, at a distance from a processing station for the blanks, and in that the blanks are fed from the supply unit to the processing station by the blank conveyor.

7. Apparatus according to claim 6, wherein the supply shafts are in conjunction with the rotatable carousel.

8. Apparatus according to claim 1, wherein the blanks are removed from a supply shaft or the fixed base shaft by an endless conveyor, the blanks resting in a transversely directed position on a conveying strand of the endless conveyor, and the blanks removed from the fixed base shaft by the endless conveyor as a result of an increased coefficient of friction.

9. Apparatus according to claim 8, wherein the increased coefficient of friction is a result of the successive blanks partially overlapping in an imbricated manner.

10. Apparatus according to claim 1, further comprising a removal station, a transfer shaft and a pusher, wherein in a region of the removal station, the blanks are removed from the transfer shaft by the pusher, the pusher moveable back and forth on the underside of the transfer shaft, the pusher having lateral, strip-like retaining surfaces for border regions of each blank, the pusher further having suction bores being arranged in the region of the strip-like retaining surfaces.

11. Apparatus according to claim 10, wherein the pusher for removing the blanks from the transfer shaft has, in the region of the strip-like retaining surfaces for the blank, carry-along elements which butt against a trailing transverse edge of the blank, the carry-along elements being dimensioned and arranged such that, during the pushing-out movement of a blank, the carry-along elements extend beneath the plane of a following blank located above.

12. Apparatus according to claim 10, the suction bores being distributed over at least one of (i) the entire length of the strip-like retaining surfaces and (ii) the entire length of abutment of the blank.

13. Apparatus according to claim 1, further comprising a transfer shaft and a removal station, the transfer shaft for accommodating a supply of blanks and formed in the region of the removal station for feeding the blanks to packs, wherein the blanks are fed to the transfer shaft by the blank conveyor, wherein the blanks removed from the transfer shaft are gripped by the blank conveyor which deflects the blank into a vertical conveying plane.

14. Apparatus according to claim 13, further comprising three drawing-off rollers, the blank being deflected into a vertical conveying by the interaction of at least two of the drawing-off rollers.

15. Apparatus according to claim 1, wherein first shaft walls form the collecting shafts and second shaft walls from the fixed base shaft, wherein the first shaft walls have on a bottom border first protrusions and depressions, wherein the second shaft walls have second protrusions and depressions, and wherein the first protrusions and depressions correspond with the second protrusions and depressions such that, when the collecting shaft is positioned on the fixed base shaft, the first protrusions and depressions and the second protrusions and depressions intermesh.

16. Apparatus for handling blanks, in particular revenue stamps for cigarette packs, namely for supplying and for feeding the same to a processing subassembly or to a cigarette pack, the apparatus comprising of an essentially upright shaft or magazine in which the blanks are stacked one above the other and on the underside of which the blanks can be removed individually by a removal element and conveyed away, wherein the shaft or the magazine includes at least two sub-shafts arranged one above the other, namely a bottom base shaft and a top collecting shaft, the top collecting shaft removable from the bottom base shaft once the top collecting shaft has been emptied of blanks and the top collecting shaft positionable back on the bottom base shaft once the top collecting shaft has been filled with blanks;

wherein a plurality of top collecting shafts are provided on a conveyor, and in that the top collecting shafts filled with blanks can be fed to the bottom base shaft and connected to the same;

wherein the conveyor is a rotatable carousel, wherein the top collecting shafts are arranged on the rotatable carousel, in a removable manner by way of a lateral securing assembly, each top collecting shaft being retained by a vertical guide with a bottom, movable support, and wherein, in the region of the bottom base shaft, the respective top collecting shaft can be lowered to a correspondingly lower-level supporting plane; and wherein the bottom, movable support is a supporting roller, and wherein in the region of the bottom base shaft, the respective top collecting shaft can be lowered by the supporting roller moving downwards to a correspondingly lower-level supporting plane.

17. Apparatus for handling blanks, in particular revenue stamps for cigarette packs, namely for supplying and for feeding the same to a processing subassembly or to a cigarette pack, the apparatus comprising of an essentially upright shaft or magazine in which the blanks are stacked one above the other and on the underside of which the blanks can be removed individually by a removal element and conveyed away, wherein the shaft or the magazine includes at least two sub-shafts arranged one above the other, namely a bottom base shaft and a top collecting shaft, the top collecting shaft removable from the bottom base shaft once the top collecting shaft has been emptied of blanks and the top collecting shaft positionable back on the bottom base shaft once the top collecting shaft has been filled with blanks;

wherein supply shafts form a supply unit which is positioned in the region of a packaging machine, at a distance from a processing station for the blanks, and in that the blanks can be fed from the supply unit to the processing station by a blank conveyor; and wherein a transfer shaft for accommodating a supply of blanks is formed in the region of a removal station for feeding the blanks to packs, and wherein the blanks can be fed to the transfer shaft by the blank conveyor.

18. Apparatus according to claim 17, wherein a belt conveyor of the blank conveyor is assigned a top belt conveyor as a counter-retaining assembly such that the blanks are transported between two abutting belt conveyors.

19. Apparatus according to claim 18, wherein the two abutting belt conveyors are elastic.

* * * * *